US010010760B1

(12) United States Patent
Crahan et al.

(10) Patent No.: US 10,010,760 B1
(45) Date of Patent: Jul. 3, 2018

(54) DOT GEOMETRY FOR A GOLF BALL SURFACE

(71) Applicant: Callaway Golf Company, Carlsbad, CA (US)

(72) Inventors: Grady C. Crahan, Carlsbad, CA (US); Craig Schnell, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 15/636,400

(22) Filed: Jun. 28, 2017

Related U.S. Application Data

(60) Provisional application No. 62/357,684, filed on Jul. 1, 2016.

(51) Int. Cl.
*A63B 37/06* (2006.01)
*A63B 37/00* (2006.01)
*A63B 45/00* (2006.01)

(52) U.S. Cl.
CPC ..... *A63B 37/0009* (2013.01); *A63B 37/0005* (2013.01); *A63B 37/0006* (2013.01); *A63B 37/0012* (2013.01); *A63B 37/0018* (2013.01); *A63B 37/0033* (2013.01); *A63B 37/0039* (2013.01); *A63B 45/00* (2013.01)

(58) Field of Classification Search
CPC ..... A63B 37/0015
USPC ..... 473/383
See application file for complete search history.

(56) References Cited

U.S. PATENT DOCUMENTS 5,916,044 A * 6/1999 Shimosaka ..... A63B 37/0004 473/377
2008/0125250 A1* 5/2008 Lee ..... A63B 37/0004 473/383
2013/0123048 A1* 5/2013 Madson ..... A63B 37/0015 473/384

* cited by examiner

*Primary Examiner* — Raeann Gorden
(74) *Attorney, Agent, or Firm* — Michael A. Catania; Sonia Lari; Rebecca Hanovice

(57) ABSTRACT

A golf ball with an aerodynamic design is disclosed herein. The aerodynamic design has a protrusion at a center of a hex geometry representing an increase in ball radius greater than 0.0005 inches from a minimum ball radius. The minimum ball radius is located between 0.01 and 0.04 inch (11%-46%) from the center of the hex geometry.

17 Claims, 9 Drawing Sheets

DOT GEOMETRY FOR A GOLF BALL SURFACE

CROSS REFERENCES TO RELATED APPLICATIONS

The Present Application claims priority to U.S. Provisional Patent Application No. 62/357,684, filed on Jul. 1, 2016, which is hereby incorporated by reference in its entirety.

STATEMENT REGARDING FEDERALLY SPONSORED RESEARCH OR DEVELOPMENT

Not Applicable

BACKGROUND OF THE INVENTION

Field of the Invention

The present invention relates to a golf ball with improved aerodynamic properties.

Description of the Related Art

The USGA has a symmetry requirement for golf balls.

Callaway Golf has used a hexagonal aerodynamic pattern on golf balls for many years.

Most golf ball dimples and hex geometries usually consist of a contour that has an always decreasing ball radius. One unique design is COMPLETE by Bridgestone. They have developed a "Dimple-in-Dimple" technology that has an increase in ball radius, but their protrusion is not located at the center of the dimple.

BRIEF SUMMARY OF THE INVENTION

The present invention improves aerodynamic distance by altering the hex geometry shape to improve the aerodynamic drag.

One aspect of the present invention is a design that has a protrusion at the center of the hex geometry representing an increase in ball radius greater than 0.0005 inches from the minimum ball radius. The minimum ball radius is located between 0.01 and 0.04 inches (11%-46%) from the center of the geometry.

Another aspect of the present invention is a golf ball comprising a core and a cover layer disposed over the core. The cover layer has a thickness ranging from 0.010 inch to 0.100 inch. The cover layer has a plurality of multi-faceted polygons defined by a plurality of lattice members. Each of the plurality of multi-faceted polygons has a protrusion extending upward from a center of each multi-faceted polygon. The protrusion represents an increase in a ball radius greater than 0.0005 inch from a minimum ball radius.

Yet another aspect of the present invention is a golf ball comprising a core, a boundary layer, and a cover layer disposed over the core. The cover layer has a thickness ranging from 0.010 inch to 0.100 inch. The cover layer has a plurality of multi-faceted polygons defined by a plurality of lattice members. Each of the multi-faceted polygons has at least fourteen facets. Each of the plurality of multi-faceted polygons has a protrusion extending upward from a center of each multi-faceted polygon. The protrusion represents an increase in a ball radius greater than 0.0005 inch from a minimum ball radius.

Yet another aspect of the present invention is a golf ball comprising a core and a cover layer disposed over the core. The cover layer has a thickness ranging from 0.010 inch to 0.100 inch. The cover layer has a plurality of dimples. Each of the plurality of dimples has a protrusion extending upward from a center of each dimple. The protrusion represents an increase in a ball radius greater than 0.0005 inch from a minimum ball radius.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
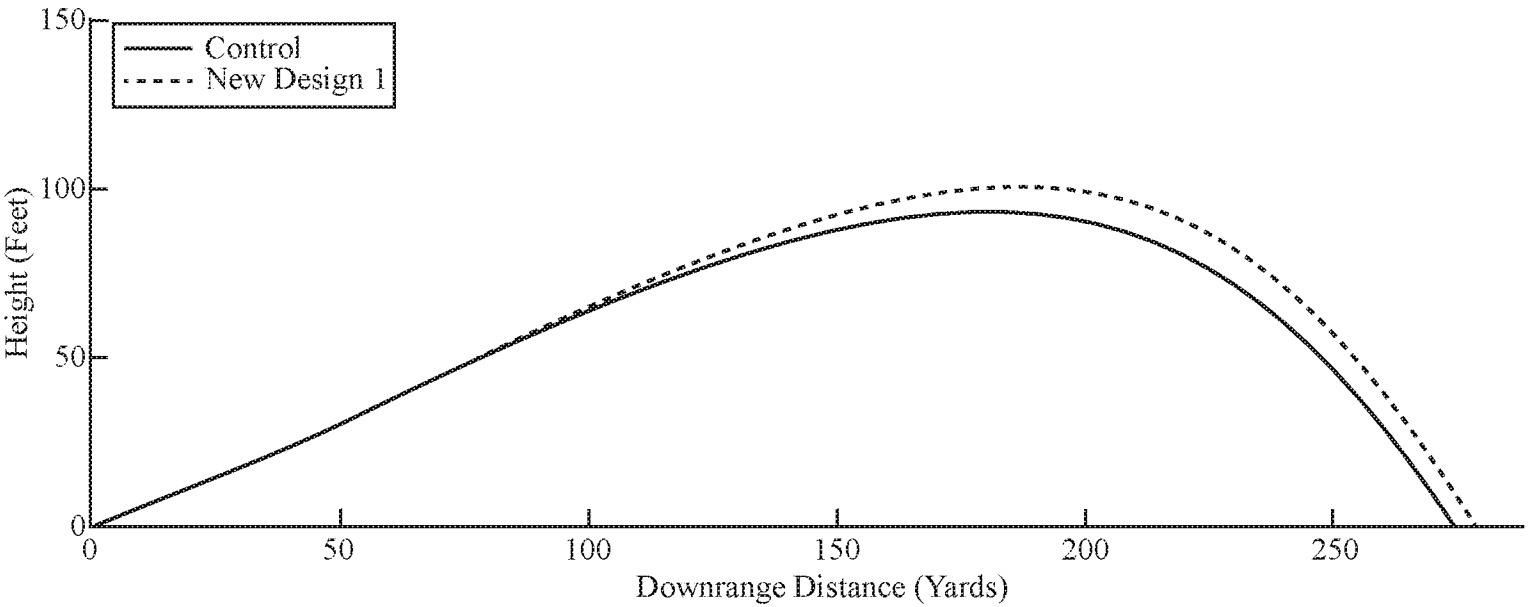
FIG. 1 is a graph of down-range distance versus height for a golf ball of the present invention and a control golf ball showing the trajectory for each design with the initial launch conditions of 167 MPH, 2450 RPM, and 10.5 Degree launch Angle.

An Indoor Test Range (ITR) was used to measure lift and drag values. The distances and trajectories shown on the following pages are based on these lift and drag values. The distance gains and trajectory differences are shown in the table below and FIG. 1.

| Design | Carry Distance (in yards) | Total Distance (in yards) | Apex Height (in feet) |
|---|---|---|---|
| Control | 275.1 | 298.2 | 93.8 |
| New Design #1 | 278.9 | 300.1 | 100.7 |

Figure 2:
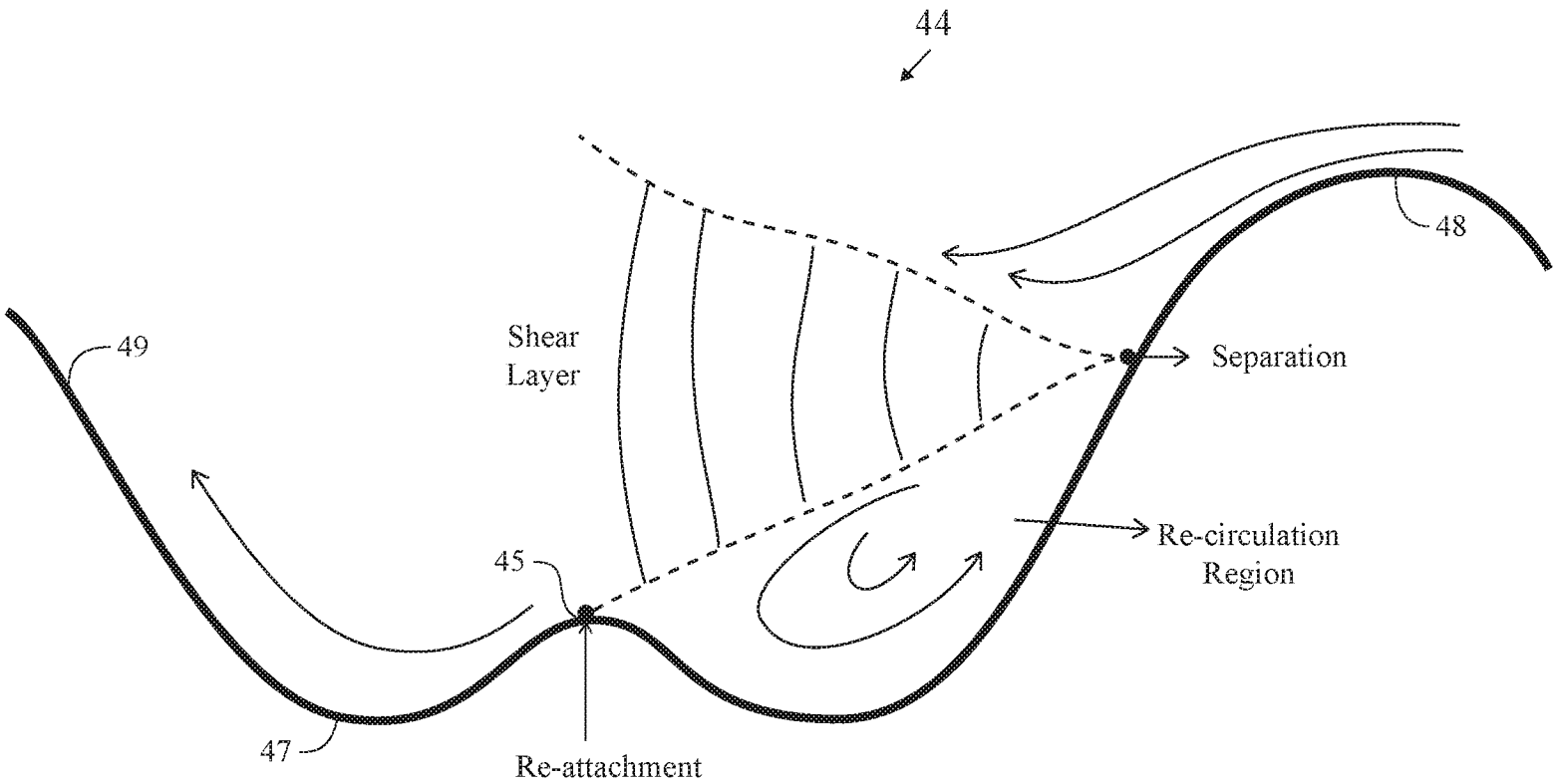
FIG. 2 is a cross-sectional view of a hexagonal surface depression of a golf ball to show the fluid flow within a dimple or hex geometry.

From a fluid dynamic perspective, as the boundary layer separates from the surface of a golf ball it forms a shear layer within the dimple. The growth rate of this shear layer is linear where a recirculation region forms near the surface and the faster freestream flow is located away from the surface. The protrusion at the bottom of the geometry allows the flow to re-attach at the bottom of the dimple and forces the recirculation region to stay upstream of the center of the dimple. Ultimately, this decreases the overall volume of the recirculation region and the overall drag of the golf ball. (See FIG. 2).

Figure 3:
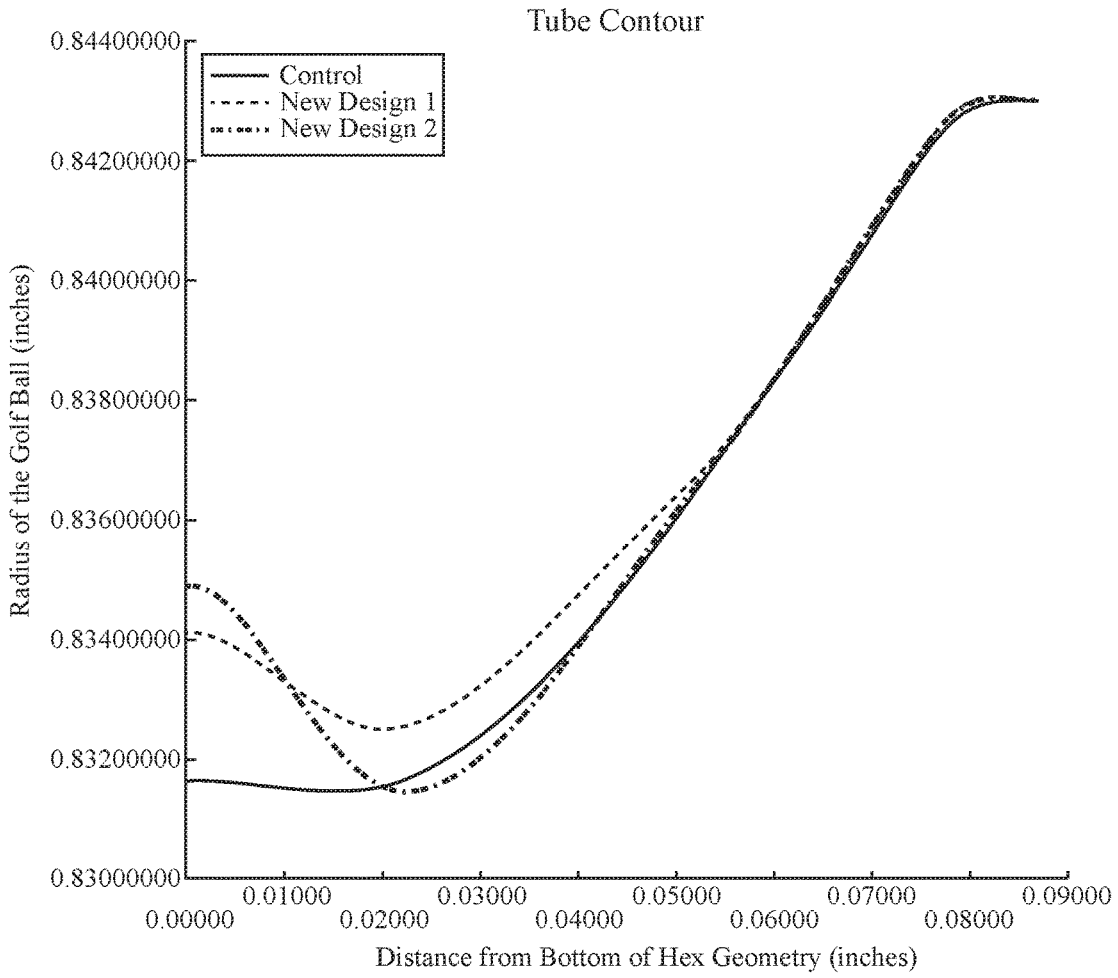
FIG. 3 is a graph of tube contour showing tube contours representing two different designs relative to a control that represents the CALLAWAY® SR2® golf ball design.

The new design, shown in FIG. 3, is defined by having a protrusion at the center of the hex geometry representing an increase in ball radius greater than 0.0005 inch from the minimum ball radius. The minimum ball radius is located between 0.01 and 0.04 inch (11%-46%) from the bottom of the geometry).

Figure 4:
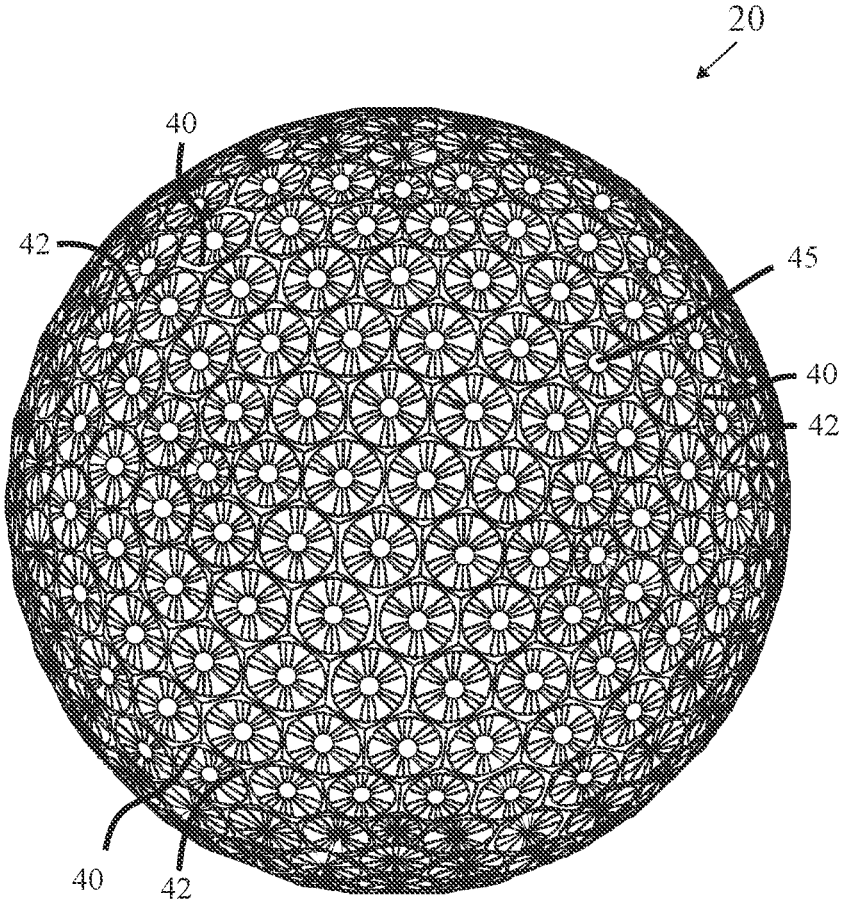
FIG. 4 is an equatorial front view of a golf ball.

FIG. 4 is an equatorial front view of a golf ball 20 shown multiple polygons with protrusions 45, and land area 40 and 42.

Figure 5:
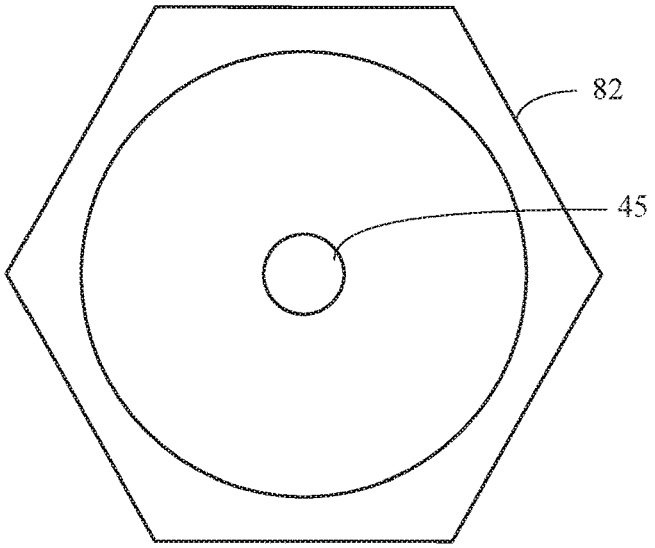
FIG. 5 is a top plan view of a hexagonal surface depression of a golf ball.

FIG. 5 is a top plan view of a hexagonal surface depression of a golf ball with a depression 45 and a tubular lattice 82.

Figure 6:
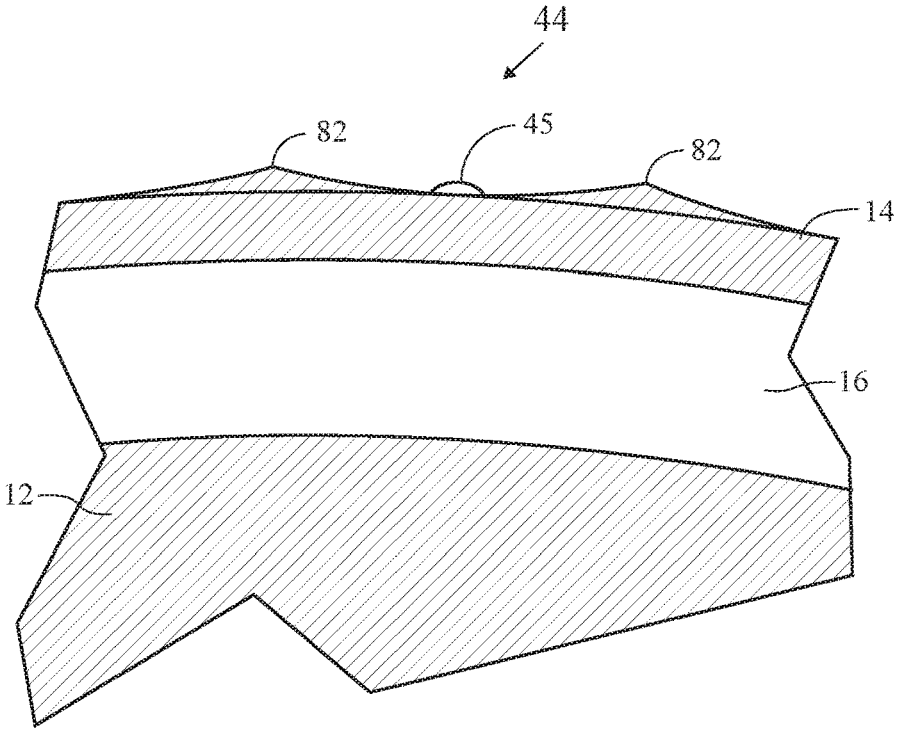
FIG. 6 is a cross-sectional view of a hexagonal surface depression of a golf ball.

FIG. 6 is a cross-sectional view of a hexagonal surface depression 44 of a golf ball with a protrusion 45, and tubular lattice 82. The golf ball has a cover layer 14, a mantle layer 16 and a core 12.

Figure 7:
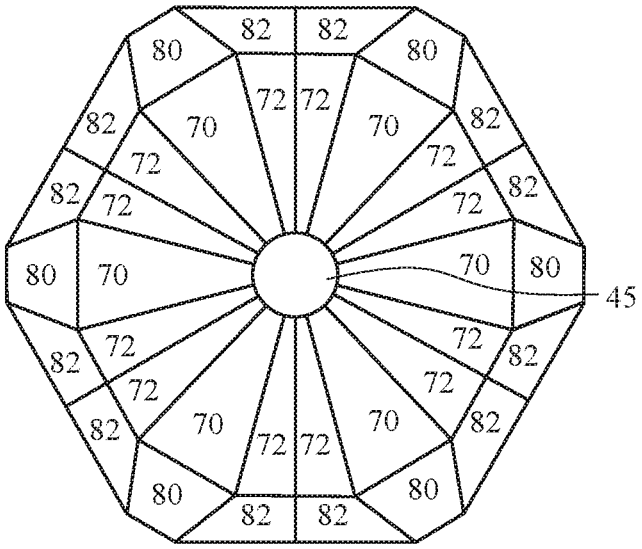
FIG. 7 is a top plan view of a hexagonal surface depression of a golf ball.
Figure 8:
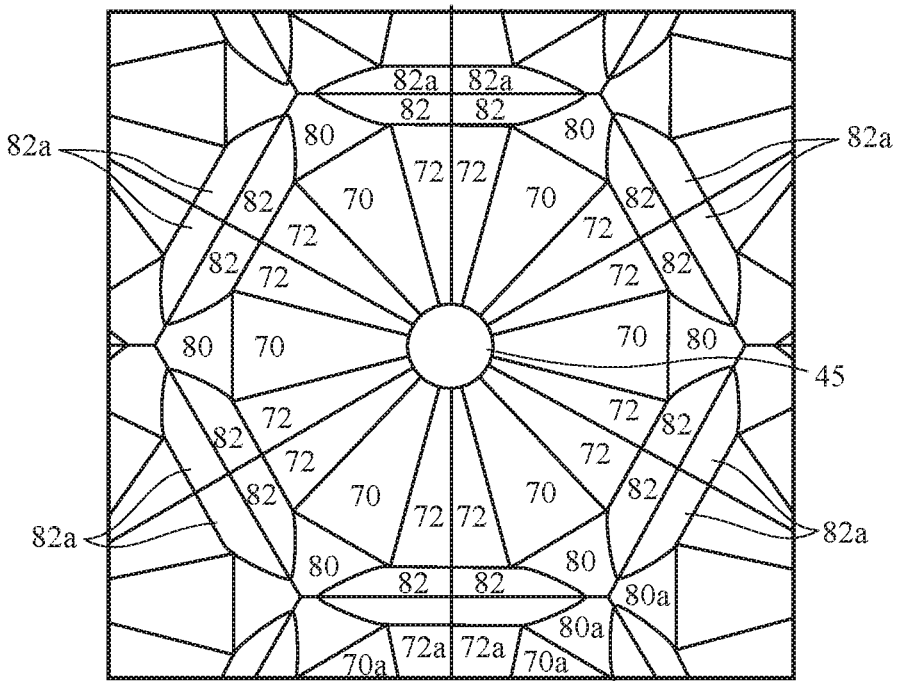
FIG. 8 is a top plan view of a hexagonal surface depression of a golf ball.

FIGS. 7 and 8 are top plan views of a hexagonal surface depression of a golf ball with a protrusion 45. Multiple facets 70,72, 80 and 82 define the polygon.

Figure 9:
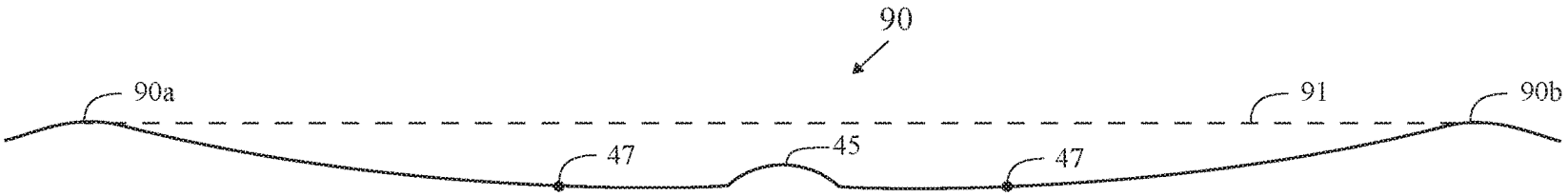
FIG. 9 is a cross-sectional view of a dimple.

FIG. 9 is a cross-sectional view of a dimple 90 with a protrusion 45, a bottom point 47 of the dimple, an edge 90*a* of the dimple, and a phantom surface 91.

Figure 10:
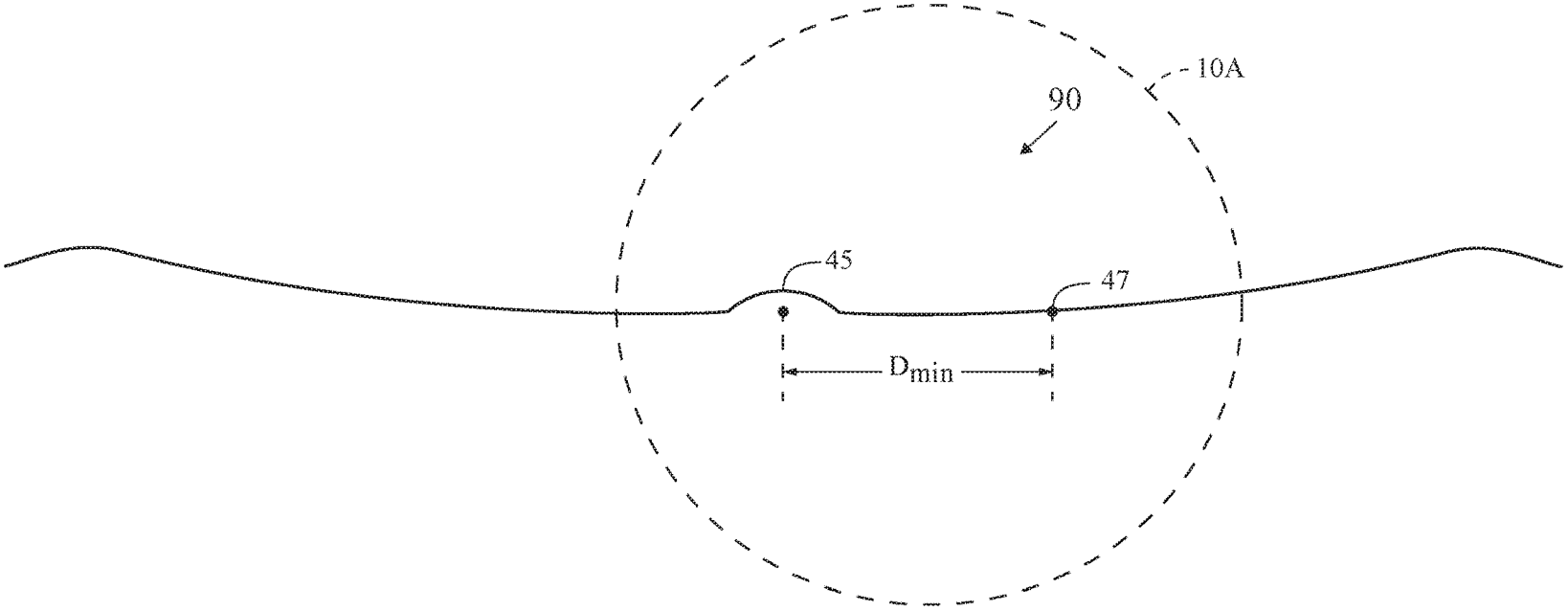
FIG. 10 is a cross-sectional view of a dimple.

FIG. 10 is a cross-sectional view of a dimple 90 with a protrusion 45 and a bottom point 47 of the dimple showing minimum ball radius is located a distance, $D_{min}$, between 0.01 and 0.04 inches (11%-46%) from the center of the geometry.

Figure 10A:
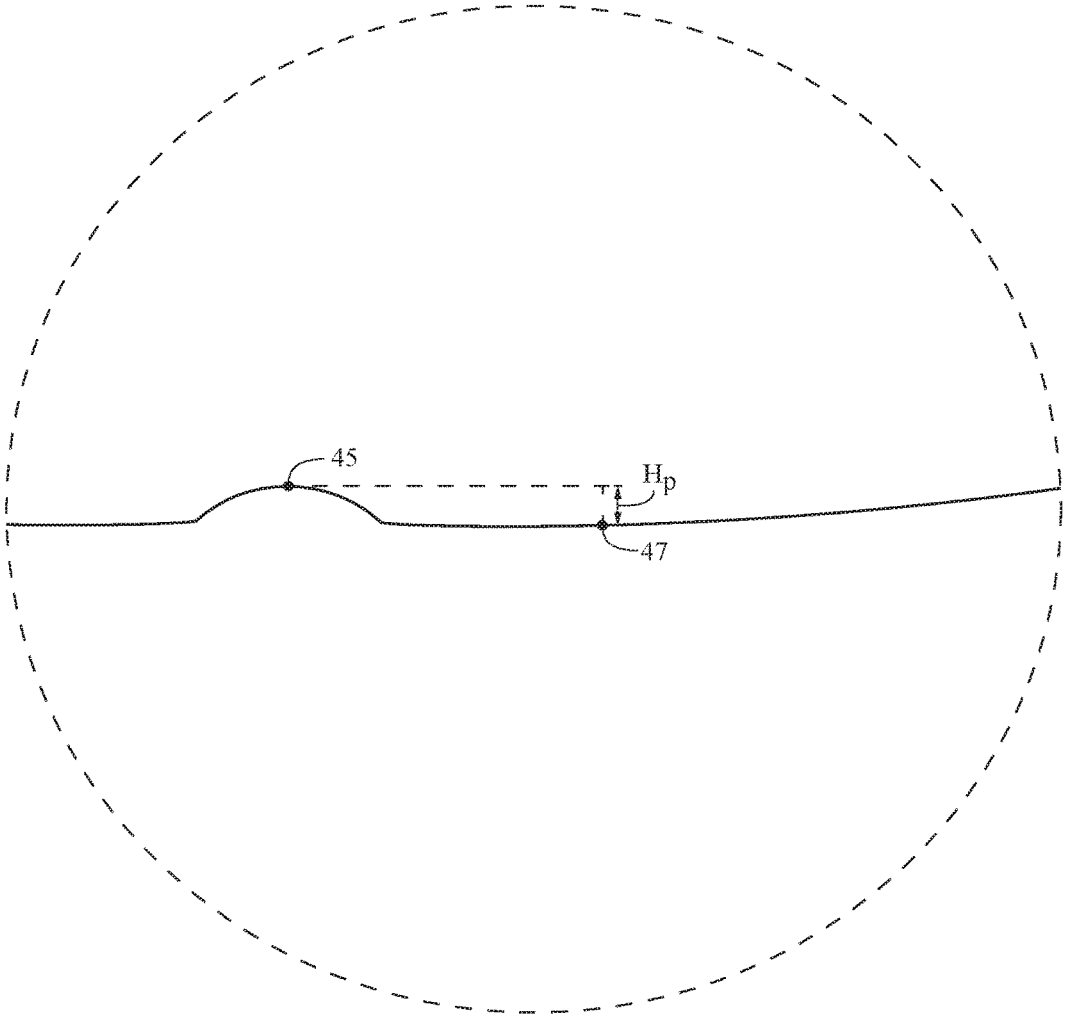
FIG. 10A is an enlarged view of circle A of FIG. 10.

FIG. 10A is an enlarged view of circle A of FIG. 10 a dimple 90 with a protrusion 45 and a bottom point 47 of the dimple showing a height, Hp, increase in a ball radius greater than 0.0005 inch from a minimum ball radius.

One construction of a golf ball utilized with the present invention is disclosed in Ogg et al., U.S. Pat. No. 8,651,976 for a Multiple Layer Golf Ball, which is hereby incorporated by reference in its entirety. Another construction of a golf ball utilized with the present invention is disclosed in Ogg et al., U.S. Pat. No. 8,475,298 for a Golf Ball Having Dual Core Deflection Differential, which is hereby incorporated by reference in its entirety.

Components of current golf ball painting systems may be employed with the present invention, and an example of such components are disclosed Skrabski et al., U.S. Pat. No. 6,544,337 for a Golf Ball Painting System, which is hereby incorporated by reference in its entirety.

In a particularly preferred embodiment of the invention, the golf ball preferably has an aerodynamic pattern such as disclosed in Simonds et al., U.S. Pat. No. 7,419,443 for a Low Volume Cover For A Golf Ball, which is hereby incorporated by reference in its entirety. Alternatively, the golf ball has an aerodynamic pattern such as disclosed in Simonds et al., U.S. Pat. No. 7,338,392 for An Aerodynamic Surface Geometry For A Golf Ball, which is hereby incorporated by reference in its entirety. Alternatively, the golf ball has an aerodynamic pattern such as disclosed in Ogg, U.S. Pat. No. 6,551,203 for A Golf Ball With Multiple Sets Of Dimples, which is hereby incorporated by reference in its entirety. Alternatively, a pattern is used such as disclosed in Simonds et al., U.S. Pat. No. 7,607,997 for a Low Volume Cover For A Golf Ball, which is hereby incorporated by reference in its entirety. Alternatively, a pattern is used such as disclosed in Simonds et al., U.S. Pat. No. 7,566,281 for a Low Volume Cover For A Golf Ball, which is hereby incorporated by reference in its entirety.

In a preferred embodiment, the cover is preferably composed of a thermoplastic polyurethane material, and preferably has a thickness ranging from 0.025 inch to 0.04 inch, and more preferably ranging from 0.03 inch to 0.04 inch. The material of the cover preferably has a Shore D plaque hardness ranging from 30 to 60, and more preferably from 40 to 50. The Shore D hardness measured on the cover is preferably less than 56 Shore D. Preferably the cover 16 has a Shore A hardness of less than 96. Alternatively, the cover 16 is composed of a thermoplastic polyurethane/polyurea material. One example is disclosed in U.S. Pat. No. 7,367,903 for a Golf Ball, which is hereby incorporated by reference in its entirety. Another example is Melanson, U.S. Pat. No. 7,641,841, which is hereby incorporated by reference in its entirety. Another example is Melanson et al, U.S. Pat. No. 7,842,211, which is hereby incorporated by reference in its entirety. Another example is Matroni et al., U.S. Pat. No. 7,867,111, which is hereby incorporated by reference in its entirety. Another example is Dewanjee et al., U.S. Pat. No. 7,785,522, which is hereby incorporated by reference in its entirety.

A discussion of the USGA initial velocity test is disclosed in Yagley et al., U.S. Pat. No. 6,595,872 for a Golf Ball With High Coefficient Of Restitution, which is hereby incorporated by reference in its entirety. Another example is Bartels et al., U.S. Pat. No. 6,648,775 for a Golf Ball With High Coefficient Of Restitution, which is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A golf ball comprising:

a core;

a cover layer disposed over the core, the cover layer having a thickness ranging from 0.010 inch to 0.100 inch, the cover layer having a plurality of multi-faceted polygons defined by a plurality of lattice members, each of the plurality of multi-faceted polygons having a protrusion extending upward from a center of each multi-faceted polygon, wherein the protrusion represents an increase in a ball radius greater than 0.0005 inch from a minimum ball radius, wherein the minimum ball radius is a lowest surface point of each multi-faceted polygon of the plurality of multi-faceted polygons;

wherein the golf ball has a diameter of at least 1.68 inches.

2. The golf ball according to claim 1 wherein the minimum ball radius is located between 0.01 inch and 0.04 inch from a center of each multi-faceted polygon.

3. The golf ball according to claim 1 wherein each of the plurality of lattice members has an apex with a width less than 0.00001 inch.

4. The golf ball according to claim 1 wherein the each of the plurality of multi-faceted polygons is either a hexagon or a pentagon.

5. The golf ball according to claim 1 wherein the plurality of multi-faceted polygons consists of 332 multi-faceted polygons.

6. The golf ball according to claim 1 wherein the each of the plurality of multi-faceted polygons has at least twenty-four facets.

7. The golf ball according to claim 6 wherein each of the plurality of multi-faceted primary polygons comprises a plurality of inner facets and a plurality of outer facets.

8. A golf ball comprising:

a core;

a boundary layer disposed over the core;

a cover layer disposed over the boundary layer, the cover layer having a thickness ranging from 0.010 inch to 0.100 inch, the cover layer having a plurality of multi-faceted polygons defined by a plurality of lattice members, each of the multi-faceted polygons having at least fourteen facets, each of the plurality of multi-faceted polygons having a protrusion extending upward from a center of each multi-faceted polygon, wherein the protrusion represents an increase in a ball radius greater than 0.0005 inch from a minimum ball radius, wherein the minimum ball radius is a lowest surface point of each multi-faceted polygon of the plurality of multi-faceted polygons and is 0.833 inch;

wherein the golf ball has a diameter of at least 1.68 inches.

9. The golf ball according to claim 8 wherein the cover layer is composed of a polyurethane material.

10. The golf ball according to claim 9 wherein the cover layer is formed by reaction injection molding.

11. The golf ball according to claim 9 wherein the cover layer is formed by casting.

12. The golf ball according to claim 8 wherein the cover layer is composed of a blend of ionomer materials.

13. The golf ball according to claim 12 wherein the cover layer is formed by injection molding.

14. The golf ball according to claim 8 wherein the core comprises a center and a mantle layer disposed around the center.

15. The golf ball according to claim 8 wherein the mantle layer is composed of a blend of ionomer materials.

16. The golf ball according to claim 8 wherein the golf ball further comprises a thread layer disposed around the core.

17. The golf ball according to claim 8 wherein the cover layer has a thickness ranging from 0.015 inch to 0.030 inch.

* * * * *